United States Patent [19]

Matsuda

[11] 4,358,631

[45] Nov. 9, 1982

[54] HEAT DISSIPATING ELECTRICAL BUSHING

[75] Inventor: Setsuyuki Matsuda, Tokyo, Japan

[73] Assignee: Mitsubishi Denki Kabushiki Kaisha, Tokyo, Japan

[21] Appl. No.: 356,586

[22] Filed: Mar. 9, 1982

Related U.S. Application Data

[63] Continuation of Ser. No. 185,716, Sep. 10, 1980, abandoned.

[51] Int. Cl.[3] ..... H01B 17/26; H01B 17/54

[52] U.S. Cl. ..... 174/15 BH; 174/15 HP

[58] Field of Search ..... 174/15 HP, 15 BH, 16 BH; 313/11.5

[56] References Cited

U.S. PATENT DOCUMENTS 3,767,835 10/1973 Engelhardt ..... 174/15 HP X 4,123,618 10/1978 Cushing et al. ..... 174/15 HP X

*Primary Examiner*—Laramie E. Askin

*Attorney, Agent, or Firm*—M. S. Yatsko

[57] ABSTRACT

An improved electrical bushing uses a refrigerant to provide cooling of both the bushing and the electrical apparatus to which the bushing is connected. The refrigerant vaporizes inside the hollow conductor of the bushing at the hot contact end, and flows to a heat dissipating device connected to the terminal end of the conductor. A liquid collecting plate collects the refrigerant which has liquefied in the heat dissipating device, and a slender tube inside the conductor transports the liquid refrigerant back to the contact end without the refrigerant contacting the intermediate portion of the conductor.

6 Claims, 4 Drawing Figures

HEAT DISSIPATING ELECTRICAL BUSHING

This is a continuation of application Ser. No. 185,716, filed Sept. 10, 1980, now abandoned.

BACKGROUND OF THE INVENTION

This invention relates generally to a bushing for electric apparatus and more particularly to a bushing for use with high voltage, large current circuits.

In recent years, the demand for power has increased and become concentrated in cities and towns. Accordingly, it has been increasingly required to increase the capacity of electric equipment or apparatus.

In increasing the capacity of electric equipment, the conduction of high currents causes the generation of heat on bushings per se employed with the electric equipment and, if properties of insulating members, packings etc. used with the bushings are considered, then a limit is required for the temperature rise due to such generation of heat and accordingly there are required bushings having a high cooling effect.

Also, bushings are used with hermetically sealed electric apparatus, and therefore if the heat generated by these sealed apparatus connected thereto can also be effectively dissipated from those bushings, then this becomes extremely advantageous in view of designing the equipment.

Conventional bushings have had disadvantages in that, although effective high capacity heat dissipation devices are required, bushings having satisfactory heat dissipation have not yet been provided.

BRIEF SUMMARY OF THE INVENTION

The present invention aims at the provision of a bushing providing the advantage of effective dissipation of heat.

In order to attain this object, the present invention provides a bushing having a hollow conductor therein having on the terminal side an end portion protruding upward and a heat dissipation device connected thereto and formed on an upper portion of an extremity thereof. A contact portion is connected to a cooled portion to absorb heat on the cooled portion, with the heat dissipation device communicating with the contact portion. A compressive refrigerant is charged in the heat dissipation device to effect cooling through the transfer of heat based on a phase change thereof. A liquid collecting plate projects from the inner wall surface of the lower end of the heat dissipation device and means for introducing the liquefied refrigerant from the bottom portion thereof into the vicinity of the contact portion or a vaporizing portion without its dropping on the inner wall surface of the conductor is provided.

BRIEF DESCRIPTION OF THE DRAWINGS

Reference is now made to the description of the preferred embodiment, illustrated in the accompanying drawings in which.

DESCRIPTION OF THE PREFERRED EMBODIMENT

Figure 1:
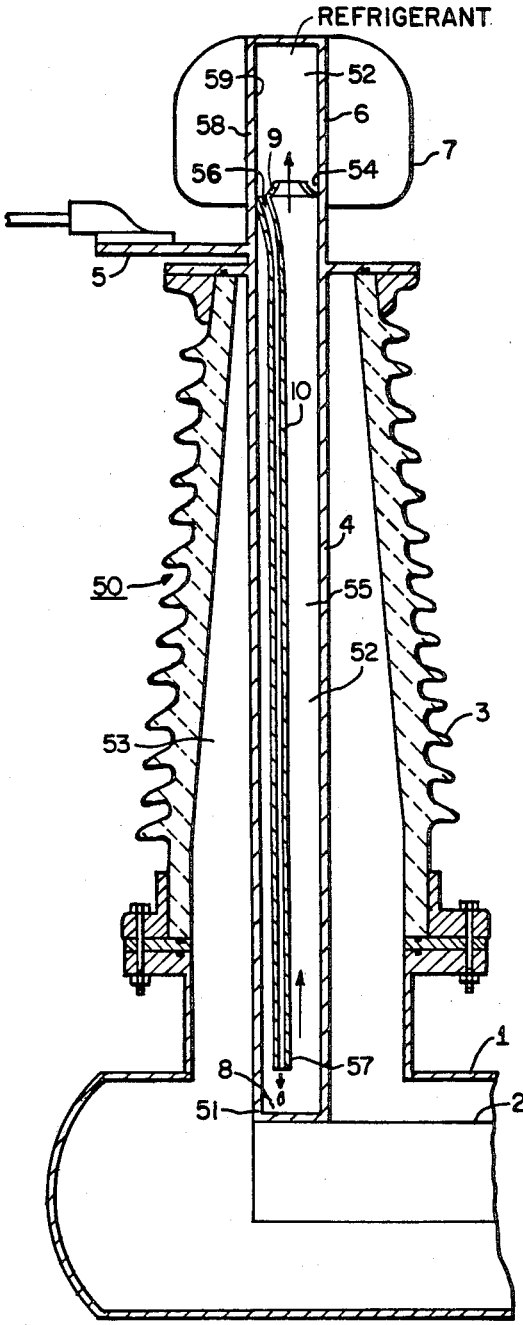
FIG. 1 is a longitudinal sectional view of a first embodiment of the present invention.

Referring now to FIG. 1, a first embodiment of the present invention as applied in connection with a sulfur hexafluoride ($SF_6$) gas insulated circuit breaker is illustrated. The reference numeral 1 is a container for a circuit breaker, the interior of which accommodates an arc-extinguishing chamber 2 filled with a gas good in insulating property such as sulfur hexafluoride ($SF_6$) gas. A porcelain shell 3 for the bushing 50 encloses a hollow conductor 4 of a hermetically sealed structure connected at one end 51 to the arc-extinguishing chamber 2 and provided at the other end with a terminal 5, a heat dissipation device 6 in communication therewith, and a heat dissipating fin 7. Current from the terminal 5 is conducted to the arc-extinguishing chamber 2 through the terminal 5 and through a contact portion 8 at the lower end 51 of the conductor 4.

In such a structure, this flow of a high current from the terminal 5 causes current conducting portions to generate heat everywhere, and the generation of heat in the arc-extinguishing chamber 2 having contacts, a sliding contact member, and so forth (not shown) therein is most intense and accordingly the resulting temperature rise is excessive. Since the contact (not shown) is required to be physically light for high speed operation, a cross-sectional area through which the current flows is inevitably apt to be small. Therefore, a large quantity of heat has been apt to be generated.

A refrigerant 52, for example Freon, is charged within both the conductor 4 and the heat dissipation device 6 communicating therewith, the refrigerant 52 being liquefied at a temperature slightly higher than the air temperature and vaporized at the temperature of conducting portions in the interior 53 of the bushing 50.

A liquid collecting plate 9 is provided on the lower portion of the heat dissipation device 6 to project from the inner wall surface 54 of the lower end of the heat dissipation device 6. A slender tube 10 extends through the interior 55 of the conductor 4 which tube 10 is opened at one end 56 in the lowermost bottom portion of the liquid collecting plate 9 and at the other end 57 in the vicinity of the contact portion 8 on the lower portion of the conductor 4.

The first embodiment of the present invention is thus constructed and the operation thereof is next described.

Current conducted to the terminal 5 is conducted through the conductor 4 and the contact portion 8 to the arc-extinguishing chamber 2 where it reaches a right-hand bushing (not shown). Heat generated at that time by the conduction and breaking or making of the breaker contacts (not shown) causes the arc-extinguishing chamber 2 to rise in temperature greatly. This heat is transferred to the contact portion 8 connected to the arc-extinguishing chamber 2, and the refrigerant 52 charged in this contact portion 8 is vaporized to cool the arc-extinguishing chamber 2 through this contact portion 8. Additionally, the vaporized refrigerant 52 ascends within the conductor 4 and passes through the liquid collecting plate 9 to enter the heat dissipation device 6. The vaporized refrigerant 52 which enters into the heat dissipation device 6 dissipates its heat to the exterior through the wall 58 of the heat dissipation device 6 and, more particularly, through heat dissipation fins 7 provided on the wall surface 58 and especially the vapor of the refrigerant 52 contacting the inner wall surface 59 of the heat dissipation device 6 is cooled to nearly the external air temperature. Thus, the vapor of the refrigerant 52 contacting the inner wall surface 59 is liquefied and tends to drop along the inner wall surface 59. However, the liquid is prevented from dropping below the liquid collecting plate 9 by means of the liquid collecting plate 9 itself, for it is collected on the liquid collecting plate 9 after which the liquid refrigerant 52 enters the slender tube 10 having the upper end opening 56 in the bottom portion of the liquid collecting plate 9. Although the liquid refrigerant 52 falls within the conductor 4, which conductor 4 is generating heat due to its conduction of the current from the arc-extinguishing chamber 2 to the terminal 5, the refrigerant 52 is scarcely vaporized until its falls down to the lower portion of the conductor 4.

The refrigerant 52 in the form of the liquid having thus fallen on the contact portion 8 at the lower end of the conductor 4 absorbs again heat from the arc-extinguishing chamber 2 through the contact portion 8 and the process as described above is repeated.

As the first embodiment of the present invention is constructed and operated as described above, the transfer of heat is effected through the utilization of a phase change due to the liquefied refrigerant. Therefore, a large quantity of heat can be transferred even though a heat transfer area is small. Moreover, the slender tube 10 has been provided within the conductor 4 to be isolated from the conductor 4 whereby the liquefied refrigerant 52 is arranged to fall within the slender tube. Therefore, the refrigerant 52 is deprived of heat and remains liquefied, and does not drop along the inner wall surface of the conductor 4 at an elevated temperature, thus avoiding a reduction in cooling effect which would be caused by the vaporization of the liquid due to its elevated temperature if it contacted the conductor 4. Thus, the refrigerant 52 is effective when it reaches down to the contact portion 8 which is most required to be cooled. Also, by isolating the conductor 4 from the slender tube 10, heat from the conductor 4 is prevented from being transferred to the slender tube 10 thereby to impede a rise of the temperature of the slender tube 10. Also, in view of the situation as described above, the rise of the temperature of the conductor 4 can be higher than that of the contact portion 8 and, furthermore, the arc-extinguishing chamber 2 connected to the contact portion 8 can be effectively subjected to the transfer of heat to cool it because the contact portion 8 is cooled directly and effectively.

Figure 2:
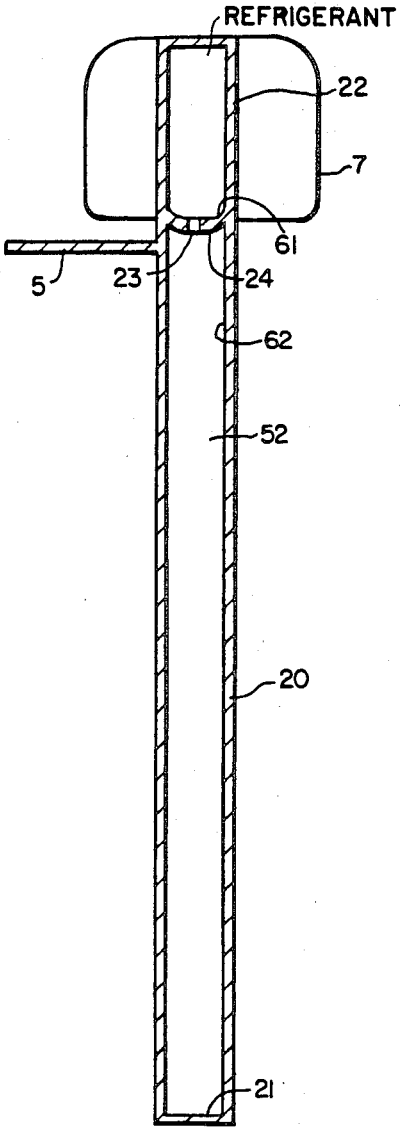
FIG. 2 is a longitudinal sectional view of a heat dissipation device and a conductor portion of a second embodiment thereof.

A second embodiment is illustrated in FIG. 2, which eliminates the slender tube 10 which has been provided on the first embodiment and is applied to bushings in which a conductor 20 is substantially vertically disposed.

In FIG. 2, the conductor 20 is provided at the lower end thereof with a contact portion 21 connected to the arc-extinguishing chamber (not shown) and on the upper portion with a heat dissipation chamber 22 as in the first embodiment. However, a liquid collecting plate 24 is provided in the interior 61 of the lower end of this heat dissipation device 22 which plate has an opening 23 therein spaced from the inner wall 62 of the conductor 20 so that, upon its falling therethrough, the liquefied refrigerant 52 falls directly on the vicinity of the contact portion 21 on the lower portion. In respects other than those described above, this embodiment is similar to the first embodiment shown in FIG. 1.

Since this second embodiment is constructed as described above, it is similar in operation to the first embodiment and has the effect entirely similar to that of the first embodiment and herewith the second embodiment has the economical effect that the slender tube 10 is omitted.

Figure 3:
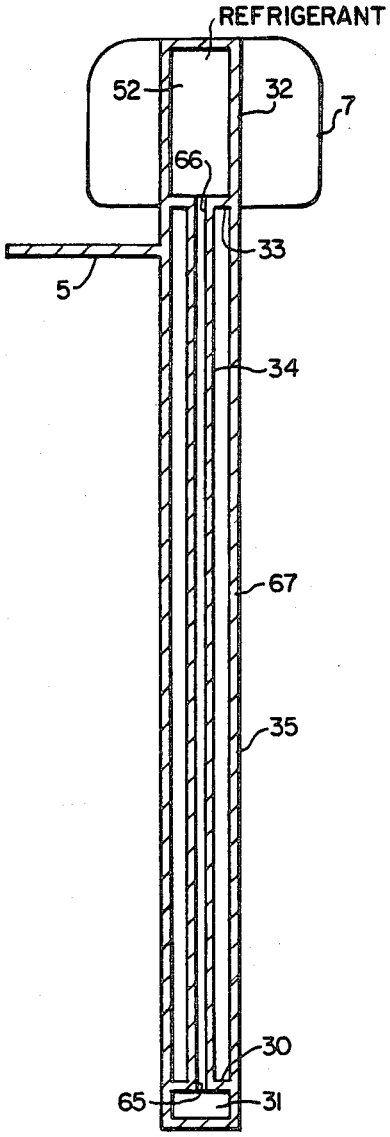
FIG. 3 is a longitudinal sectional view of the same portions of a third embodiment thereof.

FIG. 3 shows a third embodiment in which the contact portion 8 of the first embodiment forms a contact portion 31 made into a hermetically sealed structure by providing a partition 30. The heat dissipation chamber 32 is also made into a hermetically sealed structure by a liquid collecting plate 33 while holes 65, 66 provided on the partition 30 and the liquid collecting plate 33, respectively are connected through a slender tube 34 to cause the contact portion 31 to communicate with the heat dissipation chamber 32. A liquefied refrigerant 52 is charged into the heat dissipation device 32, the slender tube 34 and the contact portion 31 communicating with one another and put in a hermetically sealed structure.

Accordingly, a phase change due to the refrigerant absorbing and dissipating heat is effected only within the contact portion 31, the slender tube 34 and the heat dissipation device 32 and hence the intermediate portion 67 of a conductor 35 is not required to be in a hermetically sealed structure.

In the third embodiment thus constructed the operation thereof is also similar to that of the first embodiment and its effect is such that, as the conductor 35 is not required to be in a hermetically sealed structure, the conductor is easier to manufacture.

Figure 4:
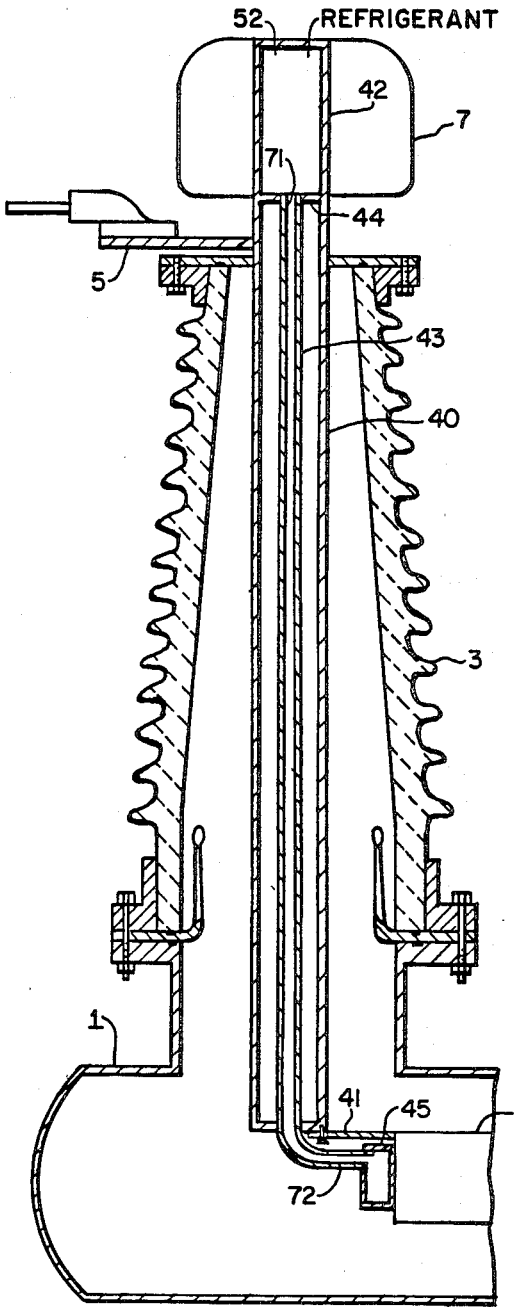
FIG. 4 is a longitudinal sectional view of a fourth embodiment thereof.

Further, a fourth embodiment is shown in FIG. 4 and applied to such cases that a conductor 40 does not directly contact elements within the arc-extinguishing chamber 2 but instead is electrically connected thereto through a connecting conductor 41. A slender tube 43 communicating with a heat dissipation device 42 is connected on the upper portion to a hole 71 on a liquid collecting plate 44 for a heat dissipation device 42 made in a hermetically sealed structure by means of the liquid collecting plate 44 as in said third embodiment, but the lower portion extends through the wall surface of the conductor 40 to extend up to the exterior of the conductor 40 and its extremity 72 communicates with and is connected to a vaporizing portion 45 provided to contact that portion of the arc-extinguishing chamber 2 having the highest cooling effect.

Since this fourth embodiment is constructed as described above, its operation is similar to that of said first through third embodiments and its effect is also similar. In this embodiment, however, the cooling effect is particularly large as compared with the first through third embodiments because the vaporizing portion 45 can be directly provided on the portion requiring the highest cooling effect.

While each of said embodiments has been described in conjunction with an upright bushing, the transfer of heat due to the vaporization may be effected with horizontally disposed bushings by providing wicks or small grooves similar in structure to heat pipes within the conductor. However, a structure may be made so that the heat dissipation device is disposed at its position somewhat higher than positions of other portions and herewith a slender tube for communicating the heat dissipation device with the contact or vaporizing portion is provided to slope so as to render the side of the contact or vaporizing portion low whereby the liquefied refrigerant is arranged to flow towards the contact or vaporizing portion. Its effect is similar to that of said three embodiments.

By disposing the heat dissipation device externally of the conductor and at the extremity thereof, for example, above the terminal 5 in FIG. 1 so as not to have a current flow through the main circuit into the heat dissipation device, heat generation on the heat dissipation device due to a current flowing therethrough is avoided. Accordingly, the better cooling effect is obtained.

By the present invention, it is possible to cool not only the bushing and the conductor but also the interior of the connected equipment. Particularly in high current bushings of 12 to 16 KA class for ultra-high voltages in which the conductor has a large diameter for dielectric performance, the cooling of the bushing is not so difficult, but the internal parts connected to the bushing are required to be cooled. The present invention is effectively applicable to the cooling of these internal parts. Accordingly, the connected parts to the bushing can also be small-sized to provide the effects that the economical and other social requirements can be sufficiently fulfilled.

For switchgears, contact portions can be small-sized due to said cooling effect, and it performs the operation at a high speed.

Those results make it possible to make electric equipment having high capacity and, accordingly, can sufficiently cope with an increase in the concentration of electric power.

I claim as my invention:

1. A bushing for electrical apparatus of the type including an outer housing, an electrode disposed within said outer housing, and an insulating gas disposed within said housing and electrically insulating said electrode from said housing, said bushing comprising:

a hollow insulating shell secured to said outer housing;

an insulating gas disposed within said shell and in open communication with the insulating gas in said outer housing;

a hollow, one-piece electrical conductor disposed within, and spaced-apart from, said shell, said conductor having a contact end extending outwardly from said shell and into said outer housing to physically contact said electrode, said conductor having a terminal end distal from said contact end extending outwardly from said shell and having an electrical terminal extending outwardly therefrom;

a heat dissipation device connected to said conductor terminal end externally of said shell, and in open communication with the interior of said conductor, a compressive refrigerant disposed in the interior of said hollow conductor, said refrigerant effecting cooling of said electrode through the transfer of heat based on a phase change due to the vaporizing of said refrigerant on said contact end and the liquefying of said refrigerant on said heat dissipation device, a liquid collecting plate projecting from the inner wall surface of the lower end of said heat dissipation device; and means for introducing said liquefied refrigerant from said liquid collecting plate to said contact end without contacting the intermediate surface of said conductor.

2. A bushing for electrical apparatus of the type including an outer housing, an electrode disposed within said outer housing, and an insulating gas disposed within said housing and electrically insulating said electrode from said housing, said bushing comprising:

a hollow insulating shell secured to said outer housing;

an insulating gas disposed within said shell and in open communication with the insulating gas in said outer housing;

a hollow one-piece electrical conductor disposed within, and spaced-apart from, said shell, said conductor having a sealed contact end and a terminal end, said contact end extending outwardly from said shell and into said outer housing to physically contact said electrode, said conductor having a partition disposed in the interior thereof at said contact end forming a contact end chamber, said partition having an opening therein, said conductor having a slender tube disposed therein and spaced-apart therefrom sealingly secured to said partition and in fluid communication with said partition opening, said terminal end extending outwardly from said shell distal from said contact end and having an electrical terminal extending outwardly therefrom;

a heat dissipation device connected to said conductor terminal end externally of said shell;

a liquid collecting plate projecting from the inner wall surface of the lower end of said heat dissipation device and hermetically sealing said heat dissipation device, said liquid collecting plate having an opening therein, said slender tube being sealingly secured to said liquid collecting plate about said plate opening such that said slender tube is in fluid communication with said heat dissipation device; and a compressive refrigerant charged in the interior of said heat dissipation device and in fluid communication with said contact end chamber through said slender tube, said refrigerant effecting cooling through the transfer of heat based on a phase change due to the vaporizing of said refrigerant in said contact end chamber and the liquefying of said refrigerant on said heat dissipation device, said refrigerant contacting said conductor only in said contact end chamber.

3. A bushing for electrical apparatus of the type including an outer housing, an electrode disposed within said outer housing, and an insulating gas disposed within said housing and electrically insulating said electrode from said housing, said bushing comprising:

a hollow insulating shell secured to said outer housing;

an insulating gas disposed within said shell and in open communication with the insulating gas in said outer housing;

a hollow one-piece electrical conductor disposed within, and spaced-apart from, said shell, said conductor having a contact end and a terminal end, said contact end extending outwardly from said shell and into said outer housing, said conductor having a slender tube disposed therein and spaced-apart therefrom, said terminal end extending outwardly from said shell distal from said contact end and having an electrical terminal extending outwardly therefrom;

an electrical connector disposed within said outer housing and electrically connecting said electrode and said conductor;

a sealed vaporizing chamber physically contacting said electrode and having an opening therein, said slender tube extending outwardly from said conductor and being sealingly secured to said vaporizing chamber and in fluid communication with said vaporizing chamber opening;

a heat dissipation device connected to said conductor terminal end externally of said shell;

a liquid collecting plate projecting from the inner wall surface of the lower end of said heat dissipation device and hermetically sealing said heat dissipation device, said liquid collecting plate having an opening therein, said slender tube being sealingly secured to said liquid collecting plate about said plate opening such that said slender tube is in fluid communication with said heat dissipation device; and a compressive refrigerant charged in the interior of said heat dissipation device and in fluid communication with said vaporizing chamber through said slender tube, said refrigerant effecting cooling through the transfer of heat based on a phase change due to the vaporizing of said refrigerant in said vaporizing chamber and the liquefying of said refrigerant on said heat dissipation device, said refrigerant being spaced-apart from said conductor along the entire length thereof.

4. The bushing according to claim 1 wherein said means for introducing the liquefied refrigerant to said contact end comprises a slender tube having one end communicating with said heat dissipation device through said liquid collecting plate and the other end opening at said contact end.

5. The bushing according to claim 1 wherein said means for introducing the liquefied refrigerant to said contact end comprises said liquid collecting plate being provided with a low portion having an opening therein such that said liquefied refrigerant falls directly to said contact end without contacting the inner wall surface of the conductor.

6. The bushing according to any of claims 1, 2 or 3 wherein said heat dissipation device is more remote than said terminal with respect to the conductor such that current flowing through the main circuit does not flow through the heat dissipation device.

* * * * *